United States Patent [19]

Lefferts

[11] Patent Number: 4,696,852

[45] Date of Patent: Sep. 29, 1987

[54] SPIRAL LINK BELT OF REDUCED AIR PERMEABILITY AND METHOD OF PRODUCING SAME

[75] Inventor: Johannes Lefferts, LM Enschede, Netherlands

[73] Assignee: Siteg Siebtechnik GmbH, Ahaus-Alstatte, Fed. Rep. of Germany

[21] Appl. No.: 845,143

[22] Filed: Mar. 27, 1986

[30] Foreign Application Priority Data

Mar. 27, 1985 [DE] Fed. Rep. of Germany ..... 3511166

[51] Int. Cl.[4] ..... B65G 15/54

[52] U.S. Cl. ..... 428/222; 245/6

[58] Field of Search ..... 428/222; 245/6

[56] References Cited

U.S. PATENT DOCUMENTS

| | | | |
|---|---|---|---|
| 4,345,730 | 8/1982 | Leuvelink | 428/221 |
| 4,346,138 | 8/1982 | Lefferts | 438/222 |
| 4,500,590 | 2/1985 | Smith | 428/222 |
| 4,567,077 | 1/1986 | Gauthier | 428/222 |

*Primary Examiner*—Marion C. McCamish
*Attorney, Agent, or Firm*—Sughrue, Mion, Zinn, Macpeak and Seas

[57] ABSTRACT

The spiral link belt consists of a multiplicity of synthetic resin helices in which the windings of one helix mesh with the windings of the adjacent helices in zipper fashion. Pintle wires are inserted into the channels formed by the meshing windings of each of two helices with the winding of the helices penetrating into the material of the pintle wires. The helices are of oval shape with heads at the winding arcs widened in the longitudinal direction of the helices. The width of the heads at the winding arcs is about one and one half to two times the diameter of the wire form which the helices are wound. The helix wire can also have a kidney-, U-or V- shaped cross section with a concave and a a convex side and can be wound so that the concave side faces inwardly or outwardly. The helices are flattened in the region of the winding arcs. Flattening is effected during thermosetting.

4 Claims, 12 Drawing Figures

FIG. 5
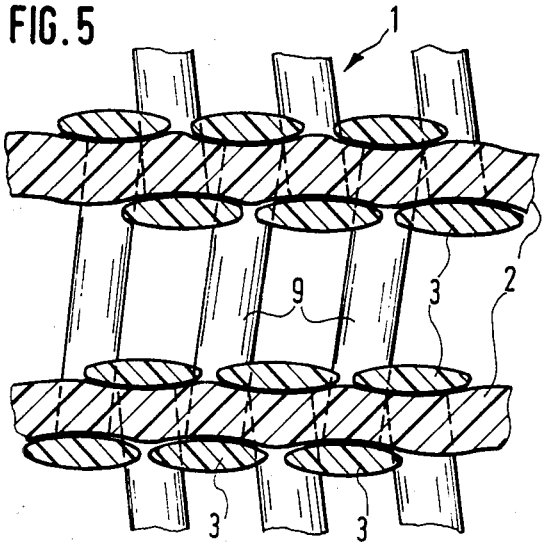
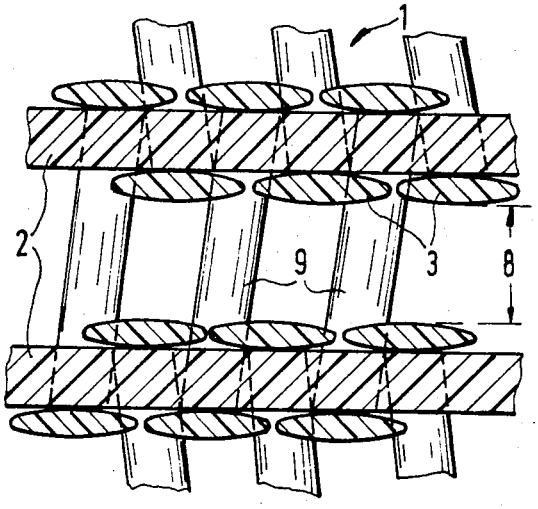
FIG. 4

SPIRAL LINK BELT OF REDUCED AIR PERMEABILITY AND METHOD OF PRODUCING SAME

BACKGROUND OF THE INVENTION

The invention relates to a spiral link belt comprising a multiplicity of synthetic resin helices in which the windings of one helix mesh in zipper fashion with the windings of the adjacent helices without any tensile or compressive spring-like stess, and pintle wires inserted into th channels formed by the meshing windings of each two helices with the windings of the helices penetrating into the material of the pintle wires. The helices are of oval shape with heads at the winding arcs that are widened in the longitudinal direction of the helices and the interiors of the helices are stuffed with filler material.

In the spiral link belt disclosed in German published Application No. 31 35 140 a widening of the windings heads is discernible from FIG. 2. Such widening seems to be a result of thermosetting the spiral link belt.

U.S. Pat. No. 4,346,138 discloses that, in the course of making the helices, a minor widening of the winding heads is effected in order to ensure engagement of the helices before the pintle wires are inserted.

German published Application No. 24 19 751 discloses a spiral link belt in which the individual helices in the spiral link belt are under spring-like tensile stress. In combination with substantial widening of the winding heads, this can impart to the helices a strong coherence such that the winding heads act as coupling heads or coupling flats which lock the helices together without pintle wires as set forth in the last paragraph of the description and claim 3 of this application.

Applicants' co-pending U.S. application based on German published application No. 35 04 373 discloses the reduction of air permeability by causing the windings of the helices to cut especially deeply into the material of the pintle wires so that the penetration depth is equal to or greater than the wire thickness of the helices. To this end especially profiled pintle wires, or pintle wires sheathed with softer material, are employed. However, such pintle wires require additional production steps and thereby increase the production costs.

SUMMARY OF THE INVENTION

The present invention provides for a reduction of the air permeability by forming the helices with the width of the heads of the winding arcs being about one and one half to two times the diameter of the wires from which the helices are wound. Preferably the width of the heads of the winding arcs is about two times the diameter of the wires from which the helices are wound.

The helices with widened winding heads can be produced by a method similar to that described in U.S. Pat. No. 4,346,138 in that the wire material is wound on a mandrel having an oval or lenticular cross section. Due to this cross section the mandrel has two longitudinally extending edges so that the wire tension periodically rises and falls during the winding operation. As the wire tension abruptly rises, the wire maerial is deformed in a way which results in the widened winding heads. The more slender the oval or lenticular shape of the mandrel, and the higher the tension at which the wire is would upon the mandrel, the more pronounced is the enlargement of the winding heads. the wire can additionally be heated directly before reaching the mandrel. Moreover, it may be suitable to use a more easily deformable wire material than is customary for use in spiral link belts. Finally, the wire cross section at the winding heads can be additionally flattened by pressure wheels uring the wire material against the mandrel edge.

It is also possible to form the widened winding heads during thermosetting. To this end the helices are would from a wire with a kidney-, U- or V- shaped cross section. Such wires have a concave and a convex side, and the helices are would such that the concave side faces inwardly or outwardly. During thermosetting a sufficiently high longitudinal tension is exerted on the spiral link belt, and the temperature is selected such that the wire cross section is flattened in the region of the winding arcs where the wires contact the pintle wires. Such flattening has a widening effect. The extent of widening depends not only on the softness of the material but also and primarily on the cross sectional configuration of the synthetic resin wires employed.

As usual, the helices are wound from thermosettable synthetic resin monofilament, especially polyester monofilament. The filler material may be film ribbon-,one or more synthetic resin monofilaments, spun fiber yarn, multifilament yarn, braided tubing or the like. Hitherto, synthetic resin monofilament has been mainly used in practice.

The foregoing and other objects, features and advantages of the invention will be apparent from the following more particular description of a preferred embodiment of the invention as illustrated in the accompanying drawings.

BRIEF DESCRIPTION OF THE DRAWINGS

FIGS. 4 and 5 illustrate a section along the horizontal center plane of a spiral link belt prior to and after thermosetting, respectively.

DETAILED DESCRIPTION OF THE INVENTION

Figure 1:
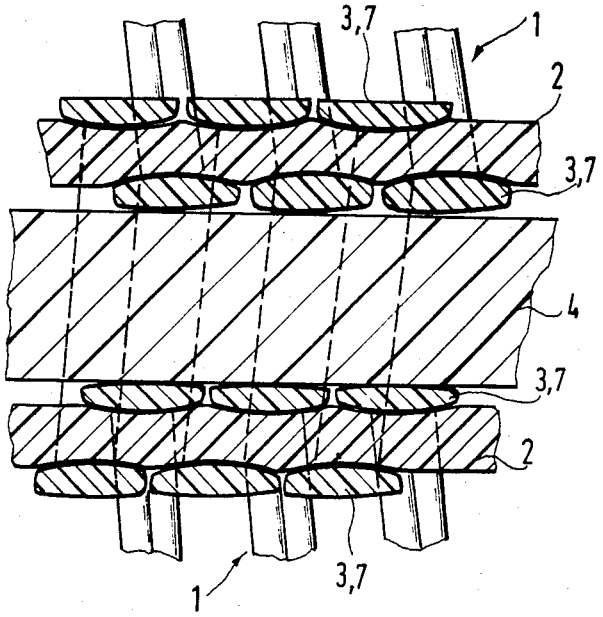
FIG. 1 shows a section along the horizontal central plane of a spiral link belt.

As in shown in FIG. 1 of Applicant's co-pending U.S. patent application based on German published Application No. 35 04 373, in a spiral link belt in which the interior of the spirals is stuffed with filler material to reduce the air permeability, there still remain empty trapezoidal areas, designated with numeral 5 in said FIG. 1, in the central plane of the spiral link belt between adjacent winding heads and the filler material 4 which permit relatively unobstructed passage of air.

In the spiral link belt of the present invention illustrated in FIG. 1 said empty trapezoidal areas are eliminated in that at the winding arcs 7 substantially widened heads 3 are formed which nearly contact one another, i.e., whose width is about equal to twice the wire thickness of the helices 1. The interior of the helices 1 is stuffed with filler material 4.

The enlargement of the heads 3 is to be confined to the extreme ends of the winding arcs 7 so that the widened heads 3 do not increase the pitch of the helices 1 in the final spiral link belt.

Figure 2:
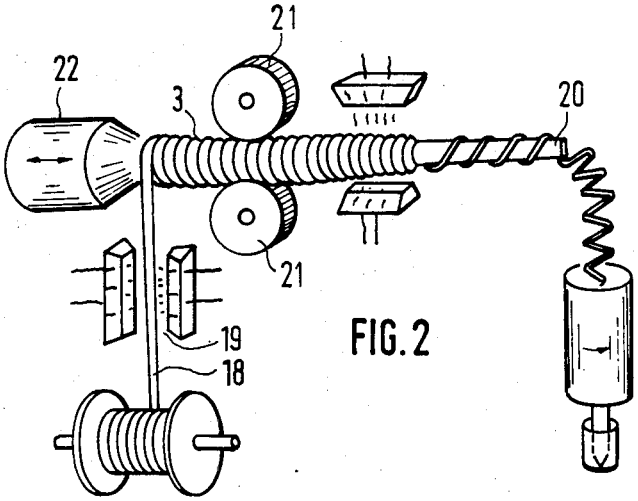
FIG. 2 shows an apparatus for producing helices with widened winding heads.

FIG. 2 illustrates an apparatus for producing helices having especially wide winding heads 3. The wire material 18 passes through a heating means 19 and is would upon a mandrel 20 whose cross section is a slender oval. The mandrel can also have a lenticular cross section with two edges. Two pressure wheels 21 can be additionally provided. They press against the edges of the mandrel 20 and flatten the winding heads 3. On the mandrel 20 a cone 22 moves back and forth. The wire 18 is pushed over the end of the mandrel 20 by the rapidly reciprocating cone 22. The widened heads 3 urge the windings of the wire 18 apart. On the mandrel 20 the coiled-up wire 18 is pushed through a termosetting zone where the shape of the helices as well as the flattening of the heads is thermoset. The helix 1 formed from the wire 18 is now set in the desired form, migrates off the tapering mandrel 20 and drops into a receptacle.

FIGS. 4 and 5 show a spiral link belt composed of helices with widened winding heads prior to and after thermosetting, respectively. While in FIG. 4, i.e., prior to thermosetting, the pintle wires 2 are straight, they are slightly undulated after thermosetting, as shown in FIG. 5. The undulatory configuration of the pintle wires 2 prevents shifting of the windings of the helices 1 along the pintle wires 2. Owing to the undulatory configuration of the pintle wires 2 the winding heads 3 bear closely against the pintle wires 2 so that there is hardly any space for the passage of air between the winding heads 3 and the pintle wires 2. The interior 8 of the helices 1 is limited laterally by the winding heads 3 and in the upward and downward directions by the winding legs 9. The substantially widened winding heads 3 nearly completely fill the lateral spaces, so that the interior of the helices 1 can be substantially completely filled by stuffing with filler material 4, and consequently the air permeability is highly reduced. It is significant in this connection that the space between adjacent winding heads 3 of the same helix 1 is as small as possible, because said space cannot be filled with filler material 4. In the illustrated embodiment said space is filled by the enlarged winding heads 3. The pitch of the helices 1 in the final spiral belt corresponds to about twice the diameter of the helix wires. Since the winding heads 3 have a width equal to twice the helix wire diameter, they touch or at least substantially reduce the free space between them in the final spiral belt.

Figure 6:
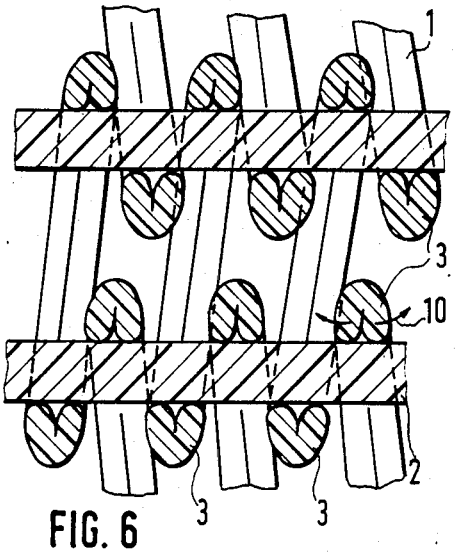
FIGS. 6 and 7 illustrate a section along the horizontal center plane of a spiral link belt prior to and after thermosetting, in which the helix wire has a kidney-shaped cross section.
Figure 7:
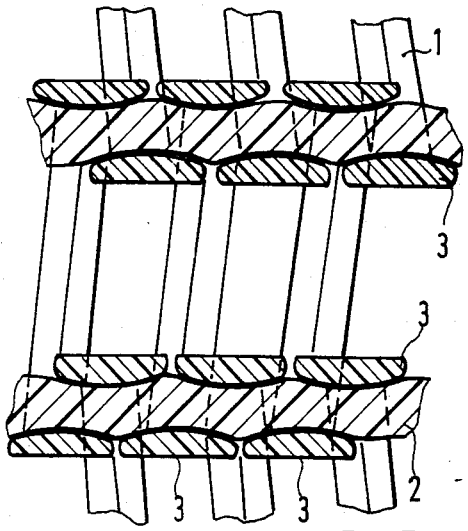
Figures 3A, 3B, 3C, 3D, 3E, 3F:
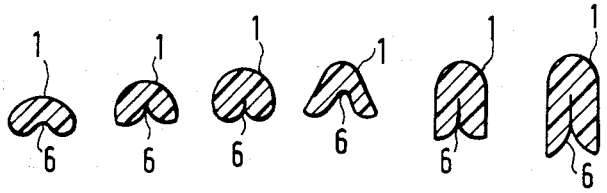
FIGS. 3*a*–3*f* show various cross sections through a helix wire.

FIGS. 3, 6, and 7 show a further possibility of attaining especially wide winding heads 3. To this end helices 1 are used which are wound from a special profile helix wire. The profile of said helix wires can be described as kidney-, U- or V-shaped. A variety of possible profiles is shown in FIG. *3a–3f*. Said profiles can also be described as a circular profile with a sector-like notch. Said helix wires are wound into helices 1 in the manner known from U.S. Pat. No. 4,346,138. By the use of a second wire designated 24 in U.S. Pat. No. 4,346,138, a predetermined pitch of the helices can be attained. The additional heating means 19 and the pressure wheels 21 normally are not necessary. The helices 1 are produced so that the special profile of the helix wire is present all along the helix 1 including the winding heads 3. The profile has a convex side and a concave or notched side 6. The helices 1 are wound in such a way that the concave or notched side 6 faces inwardly. It could as well face outwardly. FIG. 6 shows a section along the center plane of a spiral link belt made therefrom prior to thermosetting. The special profile of the helix wires is discernable in the region of the winding arcs 3. During thermosetting high longitudinal tension is exerted while the spiral link belt is heated. As a consequence, the profile of the pintle wires opens up in the region of the winding arcs, as indicated in FIG. 6 by the arrows 10. Therefore, thermosetting results in significant widening of the winding heads 3 so that the latter then have the cross section shown in FIG. 7 with which adjacent winding heads 3 of the same helix 1 contact or nearly contact each other. This ultimately leads to essentially the same embodiment of the winding heads 3 as that shown in FIG. 5.

The invention is especially suited to be realized in addition to the measures in German published application No. 35 04 373. Both embodiments can contribute to a common objective in that a somewhat less pronounced profile of the pintle wires 2, or lesser thickness of the softer sheath of the pintle wires, is complemented by widening of the winding heads 3 so that then the winding heads need to have only 1.5 times the wire thickness of the helices 1, for example. Both these measures cooperate to nearly completely close the trapezoidal area 5 in FIG. 1 of German published application No. 35 04 373.

While the invention has been particularly shown and described with reference to preferred embodiments thereof it will be understood by those in the art that the foregoing and other changes in form and details may be made therein without departing from the spirit and scope of the invention.

What is claimed is:

1. A spiral link belt comprising a multiplicity of synthetic resin helices in which the windings of one helix mesh with the windings of the adjacent helices in zipper fashion without any tensile or compressive spring-like stress, pintle wires inserted into channels formed by the meshing windings of each two helices, with the windings of said helices penetrating into the material of the pintle wires, said helices being of oval shape with heads at the windings arcs that are widened in longitudinal direction of the helices, and the interior of said helices is stuffed with filler material, wherein the width of the heads of the winding arcs corresponds to about one and one half to two times the diameter of the wire from which the helices are wound whereby empty space in the central plane of the spiral link belt between adjacent winding heads and the filler material is substantially eliminated.

2. Spiral link belt according to claim 1 wherein the wire from which the helices are wound consists of soft synthetic resin material.

3. Spiral link belt according to claim 1 or 2, wherein the helix wire has a kidney-, U- or V- shaped cross section with a concave side and a convex side, the helices are wound so that the concave side faces inwardly or outwardly, and the helices are flattened in the region of the winding arcs.

4. A method of producing a spiral link belt comprising winding a multiplicity of helices from thermosetting synthetic resin wire having a kidney-, V-, or U- shaped cross section with the concave side thereof facing inwardly or outwardly of each helix, meshing the windings of one helix with the windings of adjacent helices in zipper fashion without any tensile or compressive spring-like stress to define pintle receiving channels, inserting a pintle in each channel and thermosetting the spiral link belt under sufficient tension and with sufficiently high temperature so that the helix wires are flattened in the region of engagement with the pintles, thereby substantially filling empty space between adjacent windings on each pintle.

* * * * *